United States Patent [19]

Lebedev et al.

[11] 4,032,840

[45] June 28, 1977

[54] ADJUSTABLE TRANSFORMER

[76] Inventors: Vladimir Konstantinovich Lebedev, ulitsa Engelsa 25, kv. 12; Vladimir Alexandrovich Troitsky, ulitsa Bratislavskaya 8, kv. 86; Semen Arefievich Kalinnikov, Brest-Litovsky prospekt 17, kv. 61, all of Kiev, U.S.S.R.

[22] Filed: July 17, 1975

[21] Appl. No.: 596,747

[52] U.S. Cl. ..... 323/48; 323/50; 336/155

[51] Int. Cl.[2] ..... G05F 1/14

[58] Field of Search ..... 323/44 R, 45, 48, 50, 323/57–62; 336/155, 51–54

[56] References Cited

UNITED STATES PATENTS

| | | | |
|---|---|---|---|
| 1,932,051 | 10/1933 | Steinert | 323/44 R |
| 3,079,546 | 2/1963 | Kuba | 323/50 |

FOREIGN PATENTS OR APPLICATIONS

| | | | |
|---|---|---|---|
| 711,771 | 9/1941 | Germany | 323/50 |
| 322,500 | 12/1929 | United Kingdom | 323/50 |

*Primary Examiner*—Gerald Goldberg

[57] ABSTRACT

An adjustable transformer comprising a core with two yokes and limbs, primary and secondary power windings, one of which has a supplemental section of turns, at least one of the transformer yokes being made of at least two parallel-connected controlled magnetic circuits forming an additional transformer opening making room for housing the supplemental section turns of the power winding. Each parallel-connected magnetic circuit is provided with bias windings connected to the control network and ensuring a magnetic switching of the supplemental section of turns of the power winding. The switching is a movement of the supplemental section of turns in and out of the transformer open-circuit magnetic flux field.

7 Claims, 8 Drawing Figures

ADJUSTABLE TRANSFORMER

BACKGROUND OF THE INVENTION

The present invention relates to the electrotechnical industry, precisely to adjustable transformers.

Widely known in the art transformers regulated by the disconnection of part of the power winding turns with the aid of contactors of thyristors.

Transformers employing contactors are deprived of a smooth adjustment from the point of view of their characteristics and they are second to the two following types of transformers.

Most widely known are transformers with series-connected opposing-parallel controlled valves exercising a pulse-position or a pulse-width adjustment. But the following disadvantages are characteristic to them:

1. A low power efficiency which cannot be substantially increased by connecting capacitor batteries and sharply goes down if the load power coefficient is cos $\phi_k < 1$, where $\phi_k$ denotes load power factor.

2. The shape of voltage and current curves are considerably distorted which is greatly dangerous in case of big powers when high harmonics violate the normal operation of the connected consumers fail them.

3. If phase adjustment is exercised by thyristors the load current should be reduced.

4. Being of an equal price with the disclosed adjustable transformers they have poor reliability and in reality there are two elements of equal power in one device: a semiconductor adjuster and a transformer.

Damages to the control circuits of the thyristors (short-circuiting, discontinuity) causes failure in the device, the disclosed transformer being immune to this.

Known in the prior art are transformers with contactless switching of the power winding taps with the help of controlled valves having the advantages over the transformers discussed thereinabove only in the power efficiency and in a voltage curve shape. But their operation is still less reliable and their price is still higher since they integrate three elements: an adjustable transformer and two units of thyristors.

The automatic control circuit is still more expensive.

It is an object of the present invention to remove the above-mentioned deficiencies.

It is another object of the present invention to provide an adjustable transformer with advanced technico-economy parameters enabling to smoothly change the transformation ratio without distorting the sine shape of the output voltage.

SUMMARY OF THE INVENTION

The objects of the invention are accomplished by providing an adjustable transformer comprising a core with two yokes and limbs, primary and secondary power windings, one of which having a supplemental section of turns, at least one of the transformer yokes being made of at least two parallel-connected controlled magnetic circuits forming an additional transformer opening making room for housing the supplemental section of turns of the power winding. Each parallel-connected magnetic circuit is provided with bias windings connected to the control network and ensuring a magnetic switching of the supplemental section of turns of the power winding. The switching is a movement of the supplemental section of turns in and out of the transformer open-circuit magnetic flux field.

It is advisable to manufacture said parallel-connected magnetic circuits in the form of closed magnetic conductors, which are controlled yokes mounted whereupon are windings biased, for instance, by DC.

The feedback windings are preferred to be also mounted on said controlled yokes.

It is not less advisable to connect said feedback windings through rectifiers to additional power windings mounted on parallel-connected closed magnetic conductors.

It is expedient to connect said additional power windings mounted on one controlled yoke, to the feedback winding of the other controlled yoke.

It is preferable to connect the bias winding mounted on the same controlled yoke where the additional power winding is mounted, to the primary power winding.

It is not less preferable to provide the control network with a switching device ensuring in the process of adjusting a reswitching of the windings remagnetization and feed back mounted on the controlled yokes in such a way that the windings mounted on one magnetic conductor are opposing-connected and the windings mounted on the other conductor are aiding-connected.

It is expedient that the supplemental section of turns of the power winding mounted on said parallel-connected magnetic conductors be connected to controlled valves provided with an automatic control circuit.

The disclosed adjustable transformer enables to reduce the expenditure by several times due to high mean weighing power factor and reliability of operation compared with the transformers employing a contactless switching of leads by controlled valves and a phase-adjusting network.

The disclosed adjustable transformer provides a quality amplitude adjustment throughout the whole range, the voltage and current curves being practically sine-shaped.

As for the stability of outside characteristics and power parameters ($\eta$, cos $\phi$) they are practically not worse than that of conventional transformers adjusted with resolderings, where $\phi_k$ is a load power factor;

$\phi$ is a transformer power factor;

$\eta$ is a transformer's efficiency.

The disclosed adjustable transformer possesses considerably better reliability factors compared with those of all the power sources discussed above having semiconductor elements in the load current circuit.

BRIEF DESCRIPTION OF THE DRAWINGS

The invention will now be described in greater detail with reference to a specific embodiment thereof, taken in conjunction with the accompanying drawings, wherein.

DESCRIPTION OF THE PREFERRED EMBODIMENTS

Figure 1:
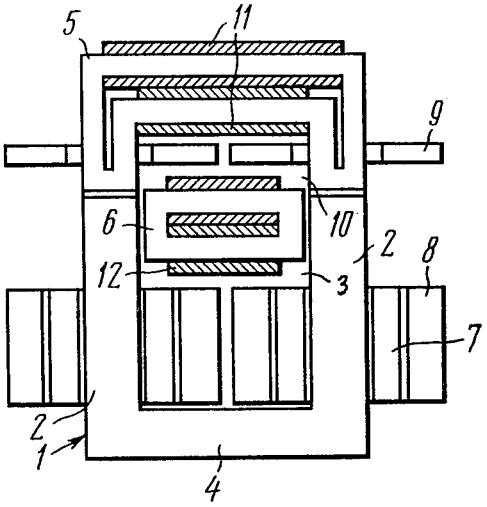
FIG. 1 is an adjustable transformer, according to the invention (a partial cutaway view)

The proposed adjustable transformer comprises a core 1 (FIG. 1), assembled of steel plates and consisting of limbs 2, three yokes 4, 5 and 6. Mounted on the limbs 2 is primary winding 7, and located above it is fixed part of turns 8 of the secondary power winding. The secondary power winding has a supplemental section of turns 9. The controlled yokes 5 and 6 of the transformer which houses the supplemental section of turns 9 of the secondary power winding. Mounted on the magnetic conductor of yoke 5 is a bias winding 11 and mounted on the magnetic conductor 6 of yoke is a bias winding 12.

Reference numeral 3 in FIG. 1 denotes the lower opening of the transformer formed by uncontrolled yoke 4 and controlled yoke 6.

Figure 2:
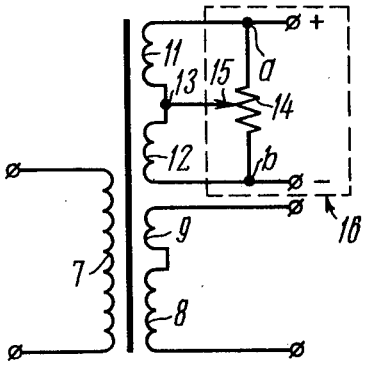
FIG. 2 is a circuit diagram of an adjustable transformer shown in FIG. 1.

The circuit diagram of the adjustable transformer illustrated in FIG. 1 is shown in FIG. 2. The bias windings 11 and 12 have a common junction 13, an adjustable resistor 14 being connected between points *a* and *b* located on the leads of said windings, a slide 15 of said resistor being connected to the common junction 13 of the bias windings 11 and 12. The adjustable resistor 14 is an element of control network 16 of the adjustable transformer. In the general case of control network 16 is a DC source.

Figure 3:
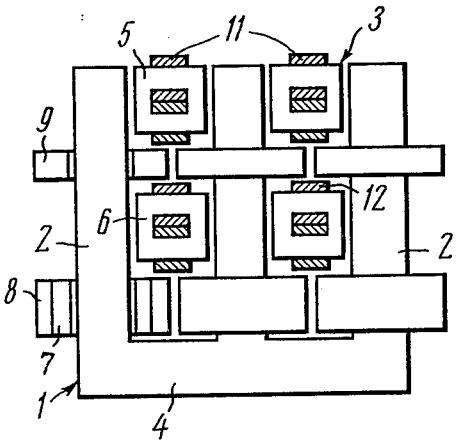
FIG. 3 is an adjustable three-phase transformer, a partial cutaway view (an embodiment of the invention)

The adjustable transformer shown in FIG. 3 contains the same elements and is of the same design as the transformer shown in FIG. 1. The difference is that it is a three-phase transformer and contains a bigger number of the component parts respectively.

Figure 4:
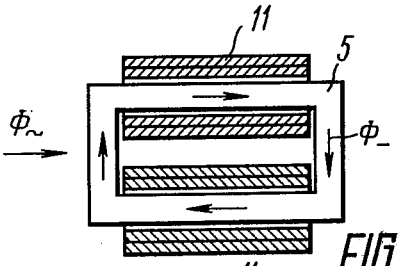
FIG. 4 is an element of a controlled magnetic circuit of yokes of an adjustable transformer shown in FIG. 3.

Shown in FIG. 4 is a closed magnetic conductor of the controlled yoke 5 of the transformer (FIG. 3) which the bias winding 11 is arranged upon. The winding 11 is made sectional, each subsequent section being wound one after the other. Such arrangement of the sections due to its simplicity of manufactured and the assembly of windings is more worthwhile than the arrangement of sections in an axial direction in a butt-joint manner to each other.

Alternating magnetic flux $\phi_{\sim}$ penetrates the windings 11 of the yoke 5. Pernament magnetic flux $\phi_{\sim}$ is closed within the magnetic conductors of the yoke 5. The arrows show the directions of the magnetic fluxes $\phi_{-}$ and $\phi_{\sim}$ .

Figure 5:
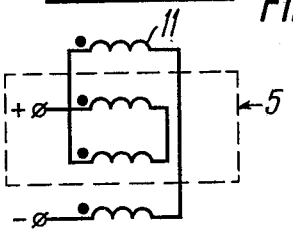
FIG. 5 is a circuit diagram of connecting the winding sections of an element of the magnetic circuit shown in FIG. 4.

Shown in FIG. 5 is an electric circuit of the connection of the bias winding 11 sections. The sections of the windings 11 are connected in series so that the resultant variable of the electromotive force is equal to zero. The structure of the closed magnetic conductor of the controlled yoke 6, as well as the electric circuit of the connection of the windings 12 sections are similar to the structure of the closed magnetic conductor of the controlled yoke 5 and the winding 11.

Figure 6:
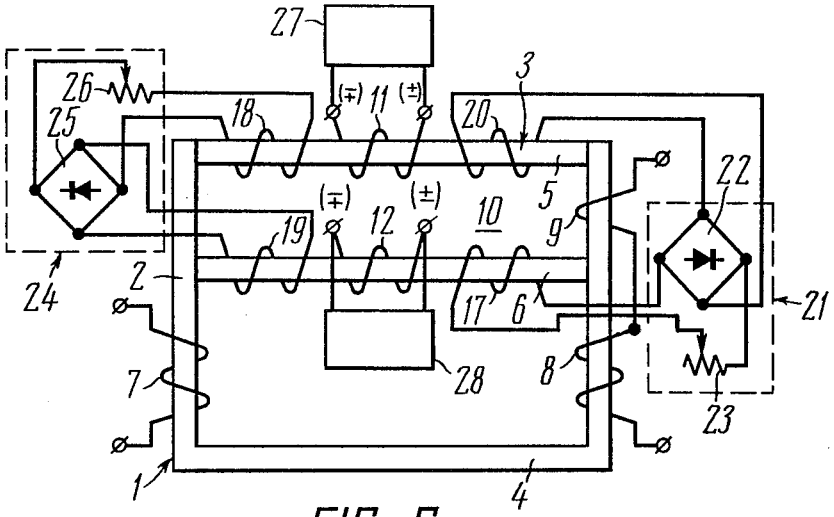
FIG. 6 is an adjustable transformer with automatic control circuits.

The transformer illustrated in FIG. 6 has a similar design with that of the adjustable transformer shown in FIG. 1. However, a feedback winding 17 and an additional power winding 19 are mounted on the controlled magnetic conductor 6, and a feedback winding 18 and an additional power winding 20 are mounted on the controlled magnetic conductor 5. The feedback winding 17 is connected to the additional winding 20 through a control network 21 containing a rectifier 22 and an adjustable resistor 23. Respectively, the feedback winding 18 is connected to the additional power winding 19 through a similar control network 24 containing a rectifier 25 and an adjustable resistor 26. The control networks 21 and 24 together with the windings 7, 20 and 19 are an adjustable DC source. The transformer employs an internal feedback which is obtained through supplying the feedback windings 17 and 18 from the additional power windings 19 and 20. The bias windings 11 and 12 are controlled by automatic control networks 27 and 29 respectively, employing any of the known circuits and containing a switching device (which is not shown on the drawing) for re-connecting the leads of the bias windings 11 and 12 from the plus to the minus and back.

Figure 7:
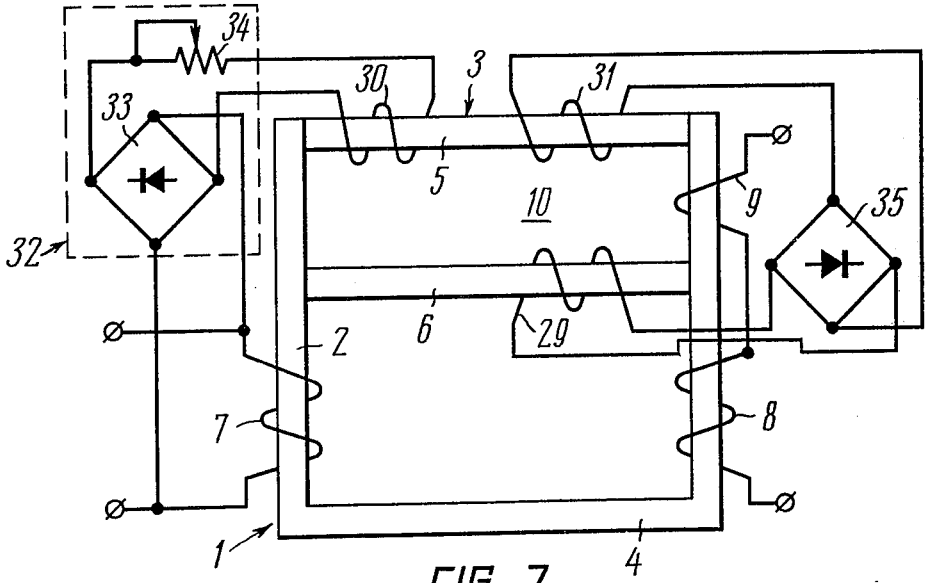
FIG. 7 is an adjustable transformer with a bias winding connected to the primary power winding.

The adjustable transformer shown in FIG. 7 also comprises the core 1 consisting of the limbs 2, the upper yoke, the lower yoke 4. The upper yoke consists of two closed magnetic conductors 5 and 6. Mounted on the limbs 2 are the unadjustable parts of turns of the primary and secondary power windings. The secondary power winding has a supplementary section of turns 9, housed in an additional opening 10 formed by the magnetic conductors 5 and 6. Mounted on the magnetic conductor 6 is a feedback winding 29, and mounted on the magnetic conductor 5 are a bias winding 30 and an additional power winding 31. The bias winding 30 is connected to fixed part of turns 7 through a control network 32 comprising a rectifier 33 and an adjustable resistor 34. The additional power winding 31 supplied the feedback winding 29 and is connected to it through a rectifier 35.

Figure 8:
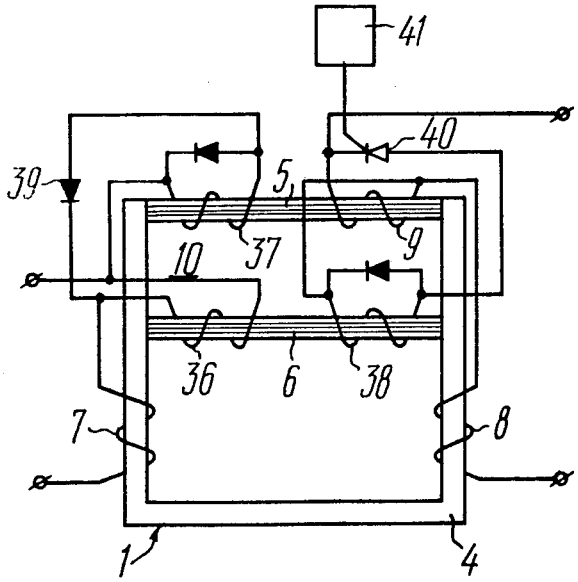
FIG. 8 is an adjustable transformer with two separated power windings.

The design of the adjustable transformer shown in FIG. 8 is similar to that shown in FIG. 1. The difference is that here the primary power winding has a supplemental section of turns 36 mounted on the magnetic conductor 6. The supplemental section of turns 9 of the secondary power winding is mounted on the magnetic conductor 5. The adjustable part of turns of the primary winding is connected, through a valve 39, to a feedback winding 37 mounted on the magnetic conductor 5. The supplemental section of turns 9 of the secondary winding is connected, through a controlled valve 40, to a feedback winding 38 mounted on the magnetic conductor 6. Thereby the internal feedback is this transformeer will be preferred by way of supplying the windings 37 and 38 from the supplemental section of turns 9 and 36 of the power winding.

The common features for all the adjustable transformer design are the following:

1. The feedback can be performed both the current and by voltage.

2. All the disclosed transformers can employ an autotransformer circuit.

3. The transformers could be made multiwound for simultaneous adjustment of the voltage for several consumers.

The process of voltage adjustment or stabilization in the adjustable transformer consists of re-distributing the open-circuit magnetic flux through the parallel-connected magnetic condutors 5 and 6 (FIG. 1). More or less dense magnetic flux crosses the supplemental section of turns 9 (FIGS. 1 and 2) of the secondary winding. Similar to the transformer with a re-connection of power winding leads, the supplemental section of turns 9 of the proposed adjustable transformer is moved in or out of the open-circuit magnetic flux field of the transformer, but the adjustment is exercised without any contact breaking, continuously, without any direct influence on the power windings, by way of redestributing the open-circuit magnetic flux of the transformer.

The transformer voltage is adjusted by the windings 11 and 12 connected to the control network 16. If the slide 15 of the resistor 14 is in the point *a* the contact voltage is applied to the bias winding 12. A maximum current flows through it and saturates the magnetic conductor 6. The alternating magnetic flux is closed through the magnetic conductor 5. The maximum e.m.f. is induced in the adjustable turns 9 of the secondary winding. That being the case, the voltage at the transformer output is maximum.

If the slide 15 of the resistor 14 is in the point *b* the winding 11 is energized. The magnetic conductor 5 is saturated. This alternating magnetic flux is closed through the magnetic conductor 6. The e.m.f. will not be induced in the supplemental section of turns 9 of the secondary winding. At this moment the voltage at the transformer output is minimum.

Simultaneously biasing both controlled magnetic conductors 5 and 6 in such a way that the sum of their permeance is approximately equal to the permeance of one unbiased magnetic conductor, it is possible to obtain any intermediate rating of the transformer output voltage.

The three-phase transformer is adjusted in a similar way.

Below is the discussion of the adjustment process of the transformer shown in FIG. 6.

As the winding 7 is connected to an a.c. source a major alternating magnetic flux is induced in the core 1 of the network. When the bias windings 17 and 18, 11 and 12 are disconnected from the d.c. sources, this alternating magnetic flux is closed simultaneously along the controlled yokes 5 and 6 and an alternating electromotive force is induced in the windings 20, 19. When the bias winding 17 is connected to the winding 20 via control circuit 21, a direct current will flow along the winding 17 which can be controlled by a resistor 23.

As the resistance value of the resistor 23 decreases, the direct current in the winding 17 grows and the controlled yoke 6 is magnetized in a more intensive manner. While the controlled yoke 6 is biased a greater part of the major alternating magnetic flux is closed through the controlled yoke 5. A large electromotive force is induced in the A.C. winding 20 disposed on the controlled yoke 5 and the current in the bias winding 17 grows still further. Thus, the alternation of current in the winding 17 depends upon the major alternating magnetic flux induced by the primary winding 7 and closed through the controlled yoke 5. The increase of the major magnetic flux through the controlled yoke 5 gives rise to a still greater saturation of the controlled yoke 6. A large electromotive force is induced in part 9 of the secondary winding and the voltage at the transformer's output is increased.

As the resistance value of the resistor 23 grows, the direct current in the winding 17 decreases. The major alternating magnetic flux through the controlled yoke 6 is increased, while through the controlled yoke 5 is decreased. A smaller electromotive force is induced in the A.C. winding 20 and the current in the bias winding 17 becomes still smaller.

The greater part of the magnetic flux will be closed through the intermediate yoke 6, with a lesser electromotive force being induced in the part 9 of the secondary winding, and the voltage being decreased at the transformer's output.

Biasing winding 11 connected to the control circuit 27 functions as an adjustable resistor 23. Such adjustment is automatic.

Upon connecting the winding 11 the magnetic resistance of the controlled yoke 5 goes up. The alternating magnetic flux through the yoke 5 decreases while through the yoke 6 increases. The voltage induced by the major alternating flux in the winding 20 decreases, with direct current in the bias winding 17 decreasing also, while the electromotive force induced by the alternating flux in the winding 9 and voltage at the transformer's output also decrease.

When the winding 11 is disconnected, the voltage induced in the winding 20 increases and the current in the winding 17 grows.

Magnetic resistance of the intermediate controlled yoke 6 is maximum, while magnetic resistance of the upper yoke 5 is minimum. The voltage at the transformer's output is maximum. Gradually changing the current in the bias winding 11, the transformer's secondary voltage is smoothly regulated.

In disconnecting the windings 11, 17 and 28 and connecting only the bias winding 18 direct current will start flowing through the control circuit 24 along the winding 18 towards the A.C. winding 19. This direct current is controlled by the resistor 26. As the resistance value of the resistor 26 decreases, the direct current in the winding 18 increases and the controlled yoke 5 is biased in a more intensive way.

While biasing the controlled yoke 5 the greater part of the major alternating magnetic flux is closed through the controlled yoke 6. A great electromotive force is induced in the a.c. winding 19 and the current grows still further. Thus, the increase of the major alternating flux through the controlled yoke 6 gives rise to a still greater saturation of the controlled yoke 5. A smaller electromotive force is induced in part 9 of the secondary winding and voltage at the transformer's output decreases.

As the resistance value of the resistor 26 grows, direct current in the winding 18 decreases. The major alternating magnetic flux increases through the controlled yoke 5 and decreases through the controlled yoke 6. A lesser electromotive force is induced in the A.C. winding 19 and so the current in the bias winding 18 becomes smaller. The greater part of the magnetic flux will be closed through the upper yoke 5. In part 9 of the secondary winding there is induced a large electromotive force and the voltage at the transformer's output increases. The bias winding 12 functions as an adjustable resistor 26.

Upon connecting the winding 12 to the minus the magnetic resistance of the controlled yoke 6 increases. The alternating magnetic flux through the yoke 6 decreases, while through the yoke 5 increases. Voltage induced by the major alternating flux in the winding 19 decreases.

Direct current also decreases in the bias winding 18, while the electromotive force induced by the alternating flux in the winding 9 and voltage at the transformer's output increase.

Upon disconnecting the winding 12 the voltage induced in the winding 19 increases thereby making the current grow in the winding 18. Magnetic resistance of the intermediate controlled yoke 6 is minimum, and magnetic resistance of the upper yoke 5 is maximum. Voltage is minimum at the transformer's output. Gradually changing current in the bias winding 12, it is possible to smoothly adjust the transformer's voltage.

While simultaneous connection of the bias winding 18 through the circuit 24 to the a.c. winding 19 and the bias winding 17 through the circuit 21 to the a.c. winding 20, the control is effected simultaneously with the aid of windings 11 and 12 or resistors 23 and 26.

When current is increased to a certain value in the bias winding 11 this current is decreased to the same value in the winding 12 with the aid of control units 27, 28. Similarly, as the resistance of the resistor 23 is increased to a certain value, the resistance of another resistor 26 is decreased to the same value. At the same time the total magnetic conductivity of the controlled yokes is maintained constant and equal to the magnetic conductivity of one of the controlled yokes.

While regulating it is possible to switch the windings 11 and 12.

To increase the transformer voltage the winding 12 is aiding-connected with the winding 17 and the winding 11 is opposing-connected with the windings 18. The currents in windings 17 and 18 depend on the magnitudes of the alternating magnetic fluxes in the magnetic conductors 5 and 6.

When the current flows through windings 12 and 17 the reluctance of the magnetic conductor 6 goes up and the reluctance of the magnetic conductor 5 goes down. The alternating magnetic flux crossing the adjustable part of turns 9 increases. The voltage at the transformer output increases. In order to reduce the transformer secondary voltage, the current in the windings 11 and 12 is reduced to zero. Thereafter the winding 11 is aiding-connected with the winding 18 and the winding 12 is opposing-connected with the winding 17 i.e. the windings 11 and 12 are reconnected. Thereafter the magnetic conductor 5 is biased more intensely and the alternating magnetic flux crossing the adjustable part of turns 9 decreases. The voltage at the transformer output decreases.

Let's consider the adjustment procedure for the transformer shown in FIG. 7.

When the resistor 23 resistance increases infinitely and the primary winding 7 is connected to an A.C. source an alternating magnetic flux is excited in the core 1. This alternating magnetic flux is closed in the yokes 5 and 6. While passing through the yoke 5 an electromotive force is induced in the a.c. winding 31 which is rectified by a rectifier 35 connected to the winding 29 into a direct-current voltage.

Direct curent flows in the bias winding 29 and the magnetic flux induced by this current biases the closed magnetic conductor of the yoke 6.

The number of turns of the winding 31 is chosen so as to ensure the passage of a maximum current along the winding 29 and to make the closed magnetic conductor of the yoke 6 completely permeated. Therefore, the major alternating flux excited by the winding 7 will be closed only through the yoke 5. In the part of the secondary winding a maximum e.m.f. is induced. Voltage at the transformer's output is maximum.

As the resistance of the resistor 34 decreases, voltage of an a.c. source is transformer by a rectifier 33 connected to the bias winding 30 into a d.c. voltage. Direct current starts flowing in the winding 30 and the closed magnetic conductor of the controlled yoke 5 begins to the permeated. The major alternating magnetic flux excited by the winding 7 is branched off through the controlled yoke 6. Alternating-current voltage is decreased in the winding 31 and, consequently, direct current goes down in the winding 29. Magnetic reluctance of the yoke 6 goes down, while magnetic reluctance of the yoke 5 goes up. An electromotive force induced by an alternating magnetic flux decreases in part 9 of the secondary winding, voltage also going down at the transformer's output.

When the resistance of the resistor 34 equals to zero, a maximum current flows along the bias winding 30. The controlled yoke 6 is a fully permeated. Alternating current voltage in the winding 31 equals to zero, while in the winding 29 direct current is absent.

Alternating magnetic flux excited by the winding 7 is closed along the controlled yoke 6. Voltage at the transformer's output is minimum and is determined only by the voltage at part 8 of the secondary winding. While adjusting the secondary voltage there is effected a stabilization of this voltage in this transformer against voltage variations of the a.c. source voltage (mains voltage). This source is connected to the winding 7.

In case the mains voltage goes up the current in the bias winding 30 increases, the reluctance of the magnetic conductor 5 rises. The alternating voltage at the additional power winding 31 and the current in the winding 29 go down.

The open-circuit magnetic flux permeating the magnetic conductor 5 goes down and the flux permeating the magnetic conductor 6 goes up.

The e.m.f. induced in the turns 9 and the voltage at the transformer output decreases.

It the mains voltage drops (at the primary winding 7) the current in the bias winding 30 decreases. The alternating voltage at the winding 31 increases. A bigger current flows through the winding 29.

The magnetic flux permeating the turns 9 goes up.

The voltage at the transformer output increases.

Thereby the parameters of the transformer secondary voltage is preserved, the mains voltage provided to the transformer varying. The less the unadjustable part of turns 8 of the secondary winding, the higher is the efficiency of the parameteric stabilization. The required value of the secondary voltage is adjusted with the resistor 34.

Let's consider the operation of the transformer shown in FIG. 8. When the a.c source is connected to the primary winding consisting of the two parts 7 and 36 an alternating magnetic flux is induced in the core 1. Part of the magnetic flux induced by the winding 7 is closed through the yokes 5 and 6, while the alternating magnetic flux induced by the winding 36 is closed only through the yoke 6.

If the valve 40 is closed, the voltage of part 36 of the primary winding is converted by the valve 39 connected to the winding 37, to a d.c. voltage. A maximum direct current flows along the winding 37 and permanent magnetic flux developed by this current completely permeates the yoke 5. The major alternating magnetic flux is closed only through the controlled yoke 6. The e.m.f. induced in part 9 of the secondary winding is a minimum one and the transformer's output voltage is determined by the voltage of part 8 of the secondary winding.

When the valve 40 is open, the voltage induced in part 9 of the secondary winding by the major alternating magnetic flux excited by the winding 7 is fed to the bias winding 38. Maximum direct current flows along the winding 38. The permanent magnetic flux developed by this current completely permeates the controlled yoke 6. Magnetic reluctance of the controlled yoke 5 is equal to the magnetic reluctance of the limbs 2.

The controlled yoke 6 being permeated, the a.c. source voltage (the mains voltage) is applied only to part 7 of the primary winding. Thus, the voltage increase at the transformer's output is stipulated by the e.m.f. growth at part 9 of the secondary winding, as well as the voltage by a turn.

By alternating the valve 40 conductivity angle with the aid of the control circuit 41, it is possible to obtain any intermediate value of the secondary voltage and that of the transformer.

Unlike the transformers shown in FIGS. 6 and 7, in the claimed transformer the connection between the controlled yokes 5 and 6 is effected due to the feeding of bias windings not from individual a.c. windings, but from the parts of the primary and secondary windings disposed on the controlled yokes.

What is claimed is:

1. An adjustable transformer comprising: a core having limbs and two yokes; at least one of said yokes comprising two parallel-connected controlled magnetic circuits, said magnetic circuits being in the form of closed magnetic conductors and comprising controlled yokes; primary and secondary power windings mounted on said limbs; a supplemental section of turns of at least one of said power windings arranged between said controlled yokes; a control circuit; bias windings disposed on said controlled yokes and connected to said control circuit; said bias windings ensuring magnetic switching of said supplemental section of turns of said power winding, said magnetic switching being a movement of said supplemental section of turns of said power winding in and out of the open-circuit magnetic flux field of said disconnectable transformer.

2. A transformer according to claim 1, including feedback windings arranged on said controlled yokes.

3. A transformer according to claim 2, including rectifiers and additional power windings on the controlled yokes, said feedback windings being connected through said rectifiers to said additional power windings.

4. A transformer according to claim 3, wherein said additional power winding on one of the controlled yoke is connected to the feedback winding of another controlled yoke.

5. A transformer according to claim 3 wherein said bias winding is disposed on the same controlled yoke as the said additional power winding connected to said primary power winding.

6. A transformer according to claim 3, wherein said control circuit has switching means for ensuring a reconnection in the process of adjustment of said windings mounted on said controlled yokes, so that said windings mounted on one of the magnetic conductors are opposingly connected and the windings mounted on the other magnetic conductor are aidingly connected.

7. A transformer according to claim 1, wherein said primary winding is divided into two series-connected parts, one of said parts being disposed in the lower opening of the transformer, the other of said parts being on the intermediate controlled yoke and being connected through a rectifier to the bias winding of the upper controlled yoke, part of the secondary winding being disposed in the upper opening and being connected through said rectifier to the bias winding of the intermediate controlled yoke, said rectifier having an automatic control circuit.

* * * * *